US006830540B2

(12) United States Patent
Watterson et al.

(10) Patent No.: US 6,830,540 B2
(45) Date of Patent: Dec. 14, 2004

(54) FOLDING TREADMILL

(75) Inventors: Scott R. Watterson, Logan, UT (US); William T. Dalebout, Logan, UT (US); Matthew R. Plott, River Heights, UT (US); Matthew E. McKendrick, Providence, UT (US)

(73) Assignee: Icon IP, Inc., Logan, UT (US)

( * ) Notice: Subject to any disclaimer, the term of this patent is extended or adjusted under 35 U.S.C. 154(b) by 417 days.

(21) Appl. No.: 09/775,309

(22) Filed: Feb. 1, 2001

(65) Prior Publication Data

US 2002/0103057 A1 Aug. 1, 2002

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS

| | | | | | |
|---|---|---|---|---|---|
| 1,082,940 | A | * | 12/1913 | Flora | 482/54 |
| 4,370,766 | A | * | 2/1983 | Teague | 5/133 |
| 4,664,646 | A | * | 5/1987 | Rorabaugh | 482/54 |
| 5,207,622 | A | * | 5/1993 | Wilkinson et al. | 482/54 |
| 5,897,460 | A | | 4/1999 | McBride et al. | 482/54 |
| 6,241,638 | B1 | | 6/2001 | Hurt | 482/54 |
| 6,261,209 | B1 | | 7/2001 | Coody | 482/54 |
| 6,273,843 | B1 | | 8/2001 | Lo | 482/54 |

* cited by examiner

*Primary Examiner*—Glenn E. Richman
(74) *Attorney, Agent, or Firm*—Workman Nydegger

(57) ABSTRACT

A treadmill including a support structure and a tread base pivotally mounted to the support structure. The tread base having a front portion and a rear portion rotatably coupled together by way of a folding mechanism that allows the rear portion to fold toward the front portion so that lower surfaces of the front and rear portions are substantially adjacent one to another. The folding mechanism can include a means for releasably locking the front portion to the rear portion to create a surface upon which a belt can move and upon which an individual can exercise. The treadmill can include a motion assembly that inclines and declines the tread base, while optionally causing the belt to rotate about two rollers mounted within the front portion and rear portion respectively.

35 Claims, 10 Drawing Sheets

FOLDING TREADMILL

BACKGROUND OF THE INVENTION

1. The Field of the Invention

The present invention relates to exercise equipment, and more specifically to treadmills that are capable of folding, to reduce the amount of space required to store and transport or ship the treadmill.

2. The Relevant Technology

Treadmills are popular exercise machines that enable a user to engage in a running or walking movement while maintaining a relatively stationary position. A conventional treadmill includes two major sections: a tread base and a handrail. The tread base includes a frame having rollers mounted on opposing ends thereof. A continuous belt extends around and between the two rollers to be fashioned into a flat, continuous loop. In one design, an electrical motor is connected to the front roller. When the motor is turned on, the roller spins and imparts rotational movement to the belt. In an alternative design, no motor is provided and the continuous belt rotates as the user standing on the belt walks or runs thereupon. Friction between the user and the belt causes the belt to rotate in a continuous loop around the rollers.

The handrail, typically, extends upwardly with respect to the frame of the tread base and extends across the front of the treadmill. The handrail acts as a support or stabilizer for the user as the user exercises upon the belt. Some alternative treadmills include moveable arms attached to the handrail. These movable arms enable the user to exercise their arms while running or walking on the treadmill, thereby allowing simultaneous strengthening of multiple areas of the users body and performance of an aerobic exercise workout.

Many treadmills include a console or control panel mounted on the handrail. The console allows a user to control the operation of the treadmill and receive a display of exercise related information such as elapsed time, speed, pulse, or calories burned. Controls for treadmill speed, inclination, or exercise program can also be part of the console.

In use a motorized, a user steps onto the continuous belt facing the front of the treadmill. The motor is then turned on, causing the top surface of the belt to rotate from the front of the tread base to the rear of the tread base. To maintain a stationary position on the treadmill, the user must then walk or run at a speed corresponding to the speed of the belt. If desired, the user can grasp the handrail for support. When the user is done exercising, he or she simply turns the treadmill off and steps off the continuous belt.

Early treadmills tended to be bulky due to large motors and oversized parts. Such treadmills were typically difficult to move around and required a relatively large amount of space. Accordingly, such early treadmills were almost exclusively found in spas and gyms having large amounts of floor space. Further, due to the excessive size, such treadmills were costly to transport or ship from a manufacturing facility or retail location to a spas or gym. Shipping containers used to deliver the treadmills were oversized, resulting in a cost premium to deliver the treadmill to the spa or gym. To reduce costs, the treadmills could be dismantled; however, it was difficult and time consuming to rebuild the treadmill at the spa or gym.

As engineering improved, the size and weight of treadmills decreased. Nevertheless, the size of treadmills was limited by the length and width of the base, which had to be large enough for a user to safely walk or run thereon. Due to this minimum size limitation, treadmills were significantly precluded from home or apartment use, which did not have available space to house a treadmill.

In an attempt to remedy this problem, foldable treadmills were developed. Foldable treadmills include a tread base having rollers and a continuous belt as previously described. The front of the tread base is hingedly attached to a stationary stand so that the tread base can be selectively moved between an operating position and a storage position. In the operating position, the base is substantially horizontal or substantially parallel to the surface upon which the treadmill rests. The user stands on the tread base facing the stationary stand and walks or runs thereon as discussed above. When use is completed, the tread base can be selectively moved to a storage position by lifting up the rear end of the tread base. The tread base is lifted to a substantially upright position with the front end of the tread base still rotatably connected to the stationary stand. By folding up the tread base, the treadmill takes up substantially less floor space making the treadmill more accessible for use in homes and apartments.

While foldable treadmills take up less space, they still have other drawbacks. For example, the length of the tread base remains a constraint to the size of shipping container that can be used to transport or ship the treadmill to a purchaser's location. Whether the tread base is in an operating or in a storage position, the dimensions of the tread base remain the same. Similarly, the length of the tread base is a restraint to the particular location within a user's home or apartment where the treadmill can be stored. It would, therefore, be an advance to provide an easily transportable treadmill capable of being stored in space smaller than is typically required for conventional treadmills. Further, it would be an advance to provide a treadmill that gives a user an aerobic and/or anaerobic exercise, while being simple to transport and store.

BRIEF SUMMARY OF THE INVENTION

It is an object of the present invention, therefore, to provide a treadmill that is capable of collapsing or folding to reduce the amount of space required to store and transport the treadmill, while being capable of providing an exercising individual with an aerobic exercise workout.

It is another object of the present invention is to provide a treadmill that is capable of reducing the overall length of the tread base to reduce the space required to store or transport the treadmill.

Yet another object of the present invention is to provide a treadmill that is capable of reducing the overall length of the tread base in a simple and efficient manner.

A further object of the present invention is to provide a treadmill that can be stored in a variety of different configurations to provide an individual, spa or gym, or a retail establishment with the capabilities of storing and transporting the treadmill in a variety of different manners.

It is another object of the present invention to provide a folding mechanism that prevents over rotation of the portions of the tread base during folding and unfolding of the tread base.

It is another object of the present invention to provide a tread base with a folding mechanism that securely positions a front portion of the tread base in a planar relationship with a rear portion of the tread base.

Still another object of the present invention is to provide locking mechanisms to securely retain or maintain the tread base in different storage positions.

Yet another object of the present invention is to provide a motorized treadmill that can be inclined or declined during operation of the treadmill.

The present invention is directed to exercise devices that provide an exercising individual with an aerobic and/or anaerobic exercise workout. The present invention is particularly well suited to treadmills and the manner by which such treadmills are transported from location to location and stored at an individual's home or apartment or other location.

In one embodiment, the presently described invention is incorporated within a treadmill, whether motorized or non-motorized. The treadmill has a length and a height that defines the outer dimensions of the space required to store and operate the treadmill. The present invention includes a tread base that can be folded, such as into two portions, So that the length of the tread base can be reduced to thereby substantially eliminate the tread base as the limiting factor to the size of transport container needed to ship the treadmill.

According to one aspect of the present invention, the tread base includes a front portion and a rear portion that are pivotally coupled together by way of a folding mechanism. A belt, upon which an individual can exercise, extends from substantially the proximal end of the front portion to substantially the distal end of the rear portion. In one embodiment, the folding mechanism allows the rear portion to fold toward the front portion so that lower surfaces of the front and rear portions are substantially adjacent one to another. In this manner, the length of the tread base can be selectively, substantially reduced to allow more efficient transportation and storage of the treadmill.

The folding mechanism can include a number of pivot members coupled to the front portion and the rear portion. These members enable the rear portion to pivot about the distal end of the front portion and thereby fold to reduce the overall length of the tread base. A means for locking the first portion to the second portion, such as a spring latch, releasably connects the front portion and the rear portion together in a substantially planar relationship one to another. Consequently, the front or first portion and the rear or second portion, when locked together, creates a surface upon which the belt can move and upon which an individual can exercise.

According to another aspect of the present invention, the tread base includes a pad that acts as a friction reducing member to enable the belt to more easily move during use of the treadmill. The pad can move during the folding process to prevent damage to the pad from stretching of the pad as the front portion and the rear portion move relative one to another.

The tread base can be connected to a support structure that gives stability to the tread base. In one embodiment, the support structure, such as one or more support members slidably engages with a handrail. A locking mechanism securely retains the handrail in a position selected by the exercising individual, thereby providing means for selectively varying the position of the handrail relative to the tread base and consequently enabling individuals having differing heights to position the console at various desired heights. By providing slidable engagement of the handrail with the support structure, the present invention allows the overall height of the treadmill to be reduced to allow a more efficient transportation or storage of the treadmill. When combined with the folding tread base capability of the present invention, this adjustable handrail feature enables a highly efficient, compact design.

Further, the treadmill can include a motion assembly that inclines and declines the tread base, while optionally causing the belt to rotate about two rollers formed within the tread base. The motion assembly can aid with supporting the tread base and providing a pivot point about which the tread base can rotate for storage in various different storage positions. For instance, the pivot point allows the tread base to be stored with the tread base having its maximum length or where the tread base is folded.

These advantages in addition to other objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

BRIEF DESCRIPTION OF THE DRAWINGS

In order that the manner in which the above-recited and other advantages and features of the invention are obtained, a more particular description of the invention briefly described above will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention relates, generally, to re-orientating or folding treadmills that require a small amount of space both for transporting or shipping and for storage within a user's home or apartment. The configuration of these folding treadmills reduces the size of packing container needed to transport or ship such a treadmill to a customer or a retail establishment. In this manner, the treadmill of the present invention can reduce the overall cost for purchasing treadmills by reducing the shipping costs associated with delivery of the treadmill. Further, the present invention provides a treadmill that can be easily stored in a manner typical for re-orientating treadmills or in the novel manner described herein. For instance, the present invention provides a treadmill wherein the tread base folds into a number of smaller portions, while the handrail collapses to reduce the overall height dimension of the treadmill. In this manner, the length of the tread base is no longer the limiting factor for shipping or storage of the treadmill. Consequently, shipping and storage of the presently described compactable treadmill is simpler and more efficient than currently existing treadmills.

Figure 1:
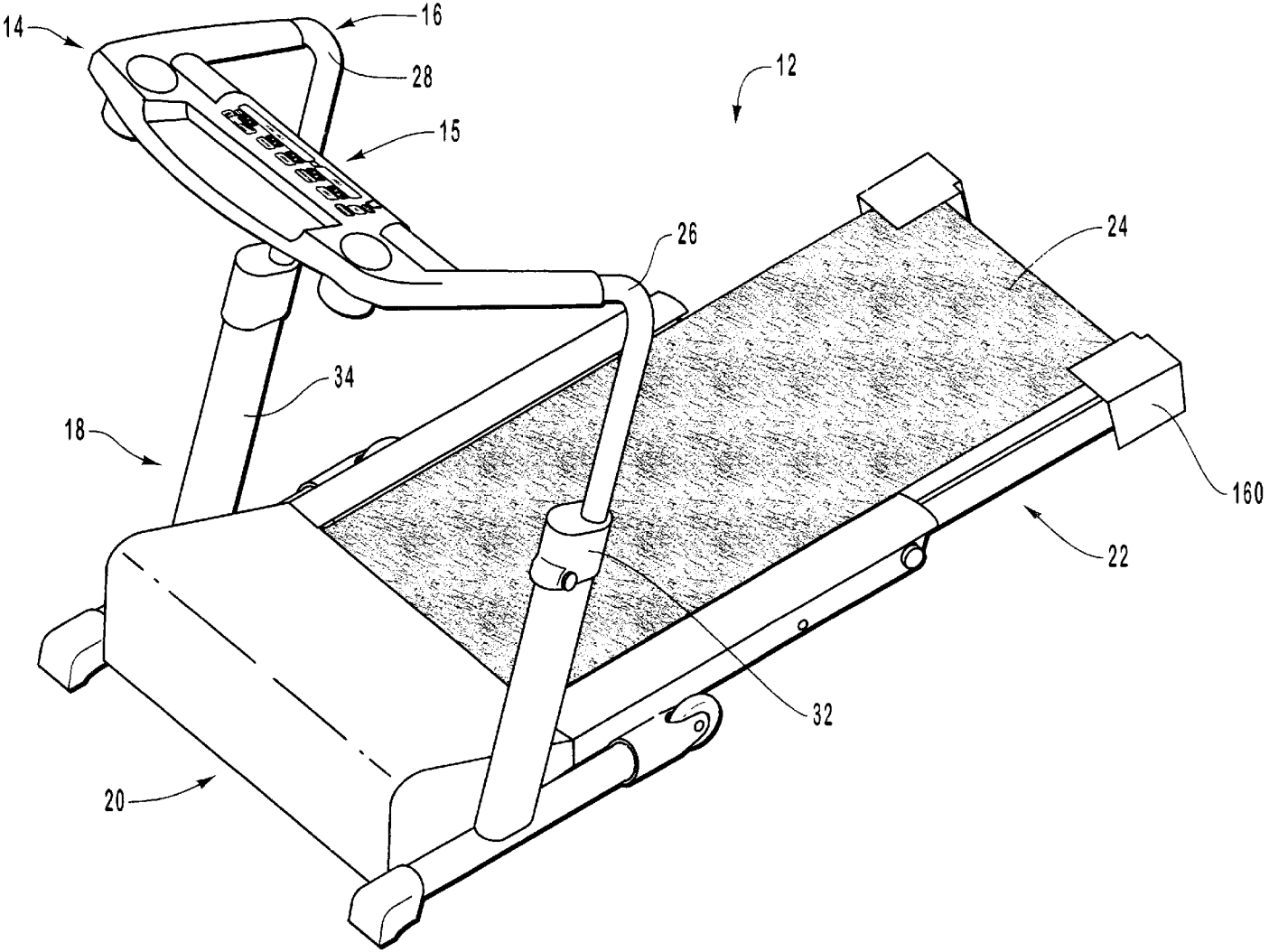
FIG. 1 illustrates a perspective representation of one embodiment of the treadmill of the present invention.

FIG. 1 generally depicts a motorized, reorienting treadmill 12 in accordance with the teaching of the present invention. Treadmill 12, in one embodiment, includes a console 14. As shown, console 14 includes various controls 15 that manage the operation of treadmill 12 during an exercise workout, such as the control of the difficulty level associated with the exercise workout performed by the exercising user. Further, console 14 can provide a place for storage of reading materials or drinks during an exercise workout, while optionally presenting the user with an interactive display that provides information or data to the exercising user. The information or data can take various forms, such as exercise data, entertainment data, and the like. One skilled in the art can identify various data that can be presented to the user.

Supporting console 14 and providing a place for a user to grasp during performance of the exercise workout is handrail 16. Optionally, handrail 16 can include one or more movable arms that a user can grasp during performance of the exercise workout to obtain additional aerobic exercise or an anaerobic exercise. Consequently, handrail 16 can have various configurations as known by one skilled in the art.

Handrail 16, as illustrated, slidably engages with a support assembly 18. The support assembly 18 of FIG. 1 includes a motion assembly 20 (see FIG. 4) that can incline and/or decline a tread base 22 upon which a user exercises during the exercise workout, while optionally powering or controlling the rotational motion of a belt 24 mounted upon tread base 22. Further, motion assembly 20, in cooperation with the other elements of support assembly 18 provides a support structure about which tread base 22 can rotate and hence move from an operating position to a storage position, and vice versa. Although discussion is made herein to support structure that includes motion assembly 20, one reasonably skilled in the art can appreciate in light of the disclosure herein that the support structure can be devoid of motion assembly 20.

As illustrated in FIG. 1, console 14 includes various controls 15 that manage the operation of treadmill 12 during an exercise workout. Console 14 can include one or more input interfaces, such as buttons and ports that enable a user to input and vary the operating parameters of treadmill 12, such as the speed at which the user exercises or the inclination of tread base 22. For instance, console 14 can include controls to vary the speed or inclination of the treadmill, the length of time a user exercises, the distance a user travels during the workout, and the like. The controls of console 14 can be embodied in a variety of different configurations to perform the desired functions. For instance, each control or input interface can take the form of one or more buttons, switches, rheostats, potentiometers, wireless type controls, such as but not limited to, infrared (IR) ports, radio frequency (RF) ports, and the like, touch sensitive controls, voice activated controls, and the like.

Optionally, console 14 can include one or more output devices or interfaces that depict or illustrate one or more of the operating parameters of treadmill 12, the performance of the exercising user, or otherwise providing encouragement or feedback to the exercising user. Consequently, console 14 can include a video display, one or more light emitting diodes (LED), a digital display, and the like to provide exercise workout information and data to the exercising user.

In addition to the above functionality and structures, console 14 can include controls to allow a user to connect to an iFit website to obtain stored or interactive user workouts, exercise information and training, and the like. One illustrative configuration of the iFit website, the related system within which treadmill 12 can be integrated, and a control panel is described in (i) co-pending patent application Ser. No. 09/641,627, filed Aug. 18, 2000 entitled "System For Interaction with Exercise Device" the disclosure of which is incorporated herein by reference; (ii) co-pending patent application Ser. No. 09/496,560, filed Aug. 18, 2000 entitled "Computer Systems and Methods For Interaction with Exercise Device" the disclosure of which is incorporated herein by reference; and (iii) co-pending patent application Ser. No. 09/641,220, filed Aug. 18, 2000 entitled "Systems and Methods For Interaction with Exercise Device" the disclosure of which is incorporated herein by reference.

Supporting console 14 is handrail 16 and support assembly 18. Handrail 16, in this configuration, includes two tubular members 26, 28 having generally the same L-shaped configuration. Each tubular member 26, 28 is configured to slidably engage with support assembly 18, while mounting to console 14. Although handrail members 26 and 28 are preferably tubular, one reasonably skilled in the art can appreciate in light of the disclosure herein that handrail 14 can include a number of solid members. Further, each tubular member 26, 28 need not have an L-shaped configuration but can have various other configurations. In addition, handrail 16 can include a single member or more than two members depending on the particular configuration of treadmill 12. Other features of handrail 16 will be discussed hereinafter with respect to its engagement with support assembly 18.

Figure 2:
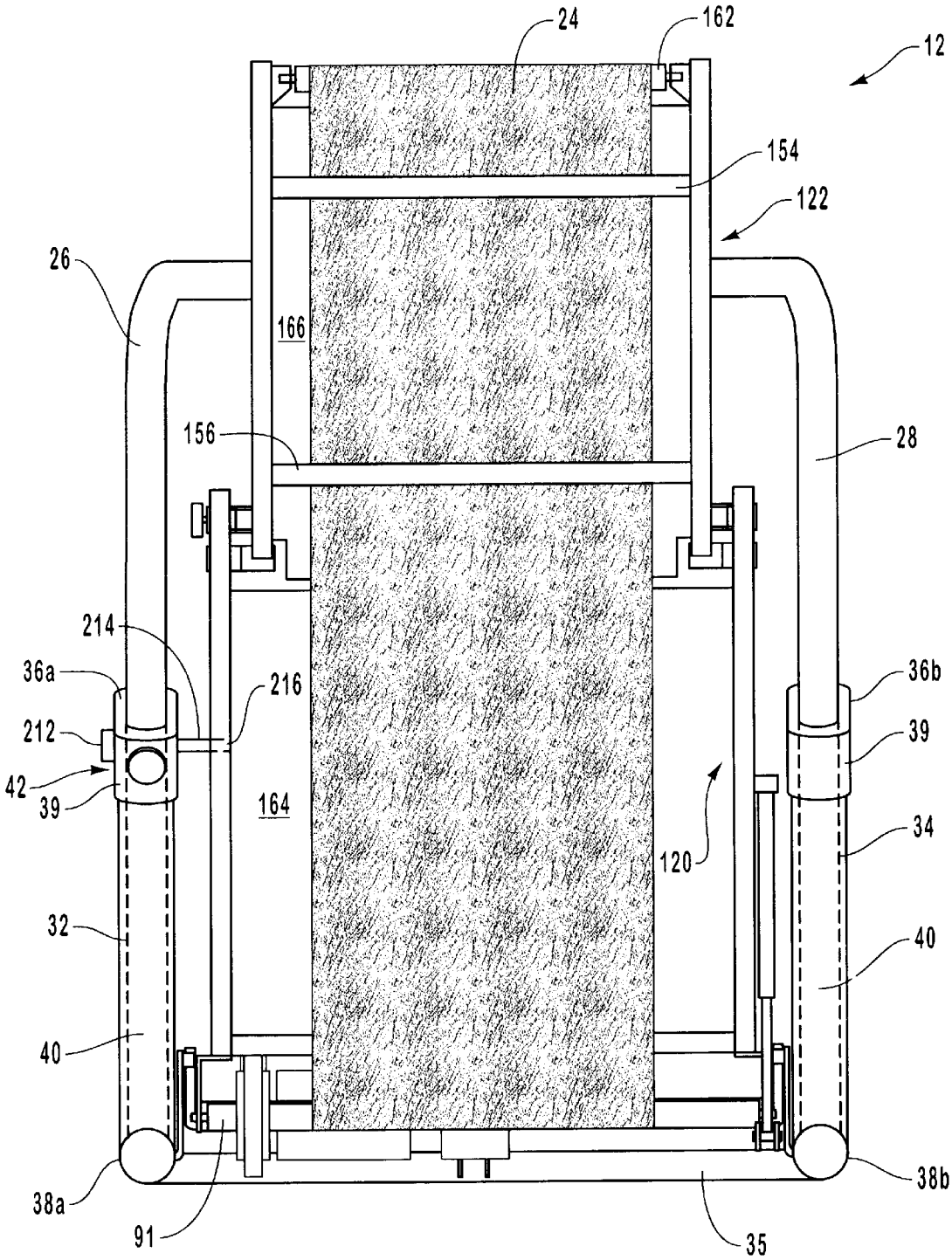
FIG. 2 illustrates a rear view of the treadmill of FIG. 1 in a first storage position.

Support assembly 18, in this embodiment, slidably engages with handrail 16 to reduce the overall height of treadmill 12 and to position console 14 at various heights to accommodate the differing heights of those users that exercise using treadmill 12. As shown in FIGS. 1 and 2, support assembly 18, in this illustrative embodiment, includes two side members 32, 34 connected together by cross member 35. Members 32 and 34 are also coupled together by console 14. As illustrated in FIGS. 1 and 2, each side member 32, 34, includes a first end 36*a*, 36*b* and a second end 38*a*, 38*b*, respectively. Covering each first end 36*a*, 36*b* is an end cap 39. Extending from first end 36*b* towards second end 38*b*, as shown in dashed lines, is a bore 40. Bore 40 is configured to accommodate handrail 16 and allow handrail 16 to slidably engage with side members 32, 34. Although bore 40 is preferred to have a generally circular cross-section, it can be appreciated by one skilled in the art that bore 40 can have various lengths and other configurations so long as bore 40 allows slidably engagement with handrail 16.

Figure 3:
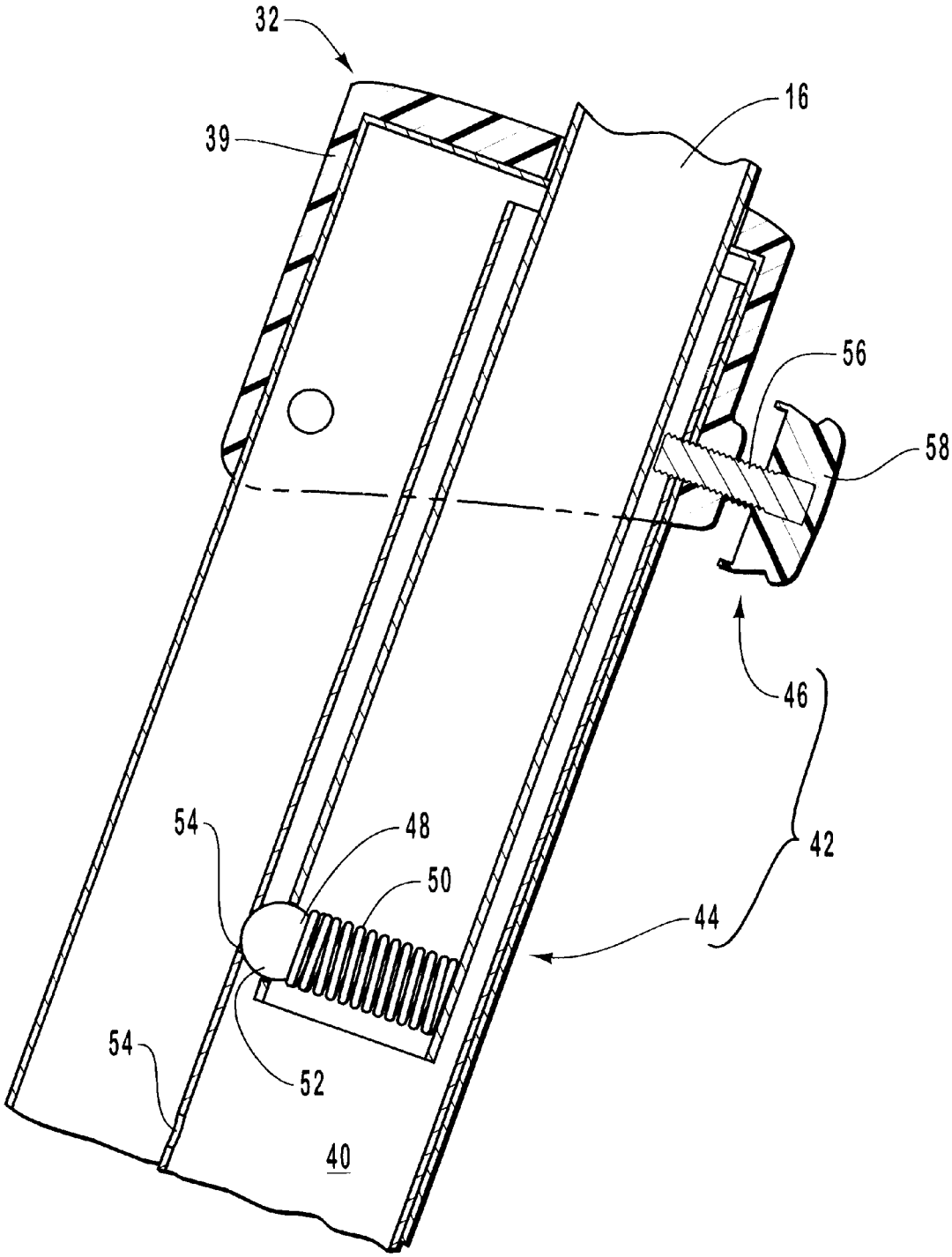
FIG. 3 illustrates a sectional side view of the junction between the handrail and side member of the treadmill of FIG. 1.

Referring now to FIG. 3, disposed at first end 36*a* of side member 32 is a locking mechanism 42 used to lock or maintain handrail 16 in a position selected by the user, such as in the storage position, i.e., compressed position, or in an operational position, i.e., extended position. Although locking mechanism 42 is illustrated as being formed on side member 32, one skilled in the art can appreciate that support assembly can include one locking mechanism 42 on side member 34 or two locking mechanisms 42, one on each side member 32, 34.

Locking mechanism 42, as illustrated, includes a ball plunger 44 and a lock down assembly 46. Ball plunger 44 includes a ball 48 biased by way of a spring 50. The ball 48 is biased within a hole 52 formed in tubular member 26 and selectively mates with one or more of a number of complementary holes 54 formed in bore 40 of side member 32. In this manner, as a user desires to position handrail 16 either in the operating position or in the storage position, the user slides handrail 16 to the desired position and ball plunger 44 maintains handrail 16 in such a position. It can be understood by one reasonably skilled in the art in light of this disclosure that such a ball plunger 44, with associated holes 52, 54 can also be formed in tubular member 28 and member 34, if desired.

To securely retain handrail in the selected position, locking mechanism 42 further includes lock down assembly 46. The lock down assembly 46 includes a threaded pin 56 with associated head 58. The threaded pin 56 engages with a threaded hole formed in side member 34 and extends into bore 40 to contact handrail 16. As a user manipulates lock down assembly 54, such as by rotating head 58, threaded pin 56 engages with handrail 16 to securely retain handrail 16 in the selected position.

One skilled in the art can identify various other locking mechanisms that are capable of performing this appropriate function. For example, in one configuration, locking mechanism 42 can take the form of only lock down assembly 46 without ball plunger 44. In another configuration, lock down assembly 46 engages with one or more holes formed in members 26, 28 of handrail 16. In still another configuration, handrail 16 includes a spring-loaded plunger. The spring-loaded plunger has a pin that engages with side member 34 and handrail 16 under the biasing action of a spring. In still another configuration, a user can pull head 58 when lock down assembly 54 takes the form of a spring-loaded plunger. In yet another configuration, locking mechanism 42 can be eliminated, while handrail 16 and bore 40 slip-fit one with another allowing positioning of console 14 and various heights. In still another configuration, bore 40 can includes a bushing that allows handrail 16 and side members 32, 34 to engage one with another applying frictional forces that limit motion of handrail 16, without the user applying a force to move handrail 16. In another configuration, handrail 16 includes a spring biased pin that extends through a hole formed in handrail 16 to engage with a complementary hole in one of side members 32, 34 and thereby lock handrail 16 in the selected position.

Generally, handrail 16 and tubular members 26, 28 can have various configurations and can be fabricated from various materials. For example, handrail 16 can be fabricated from, but not limited to metals, plastics, composites, combinations thereof, or the like, for example.

Figure 4:
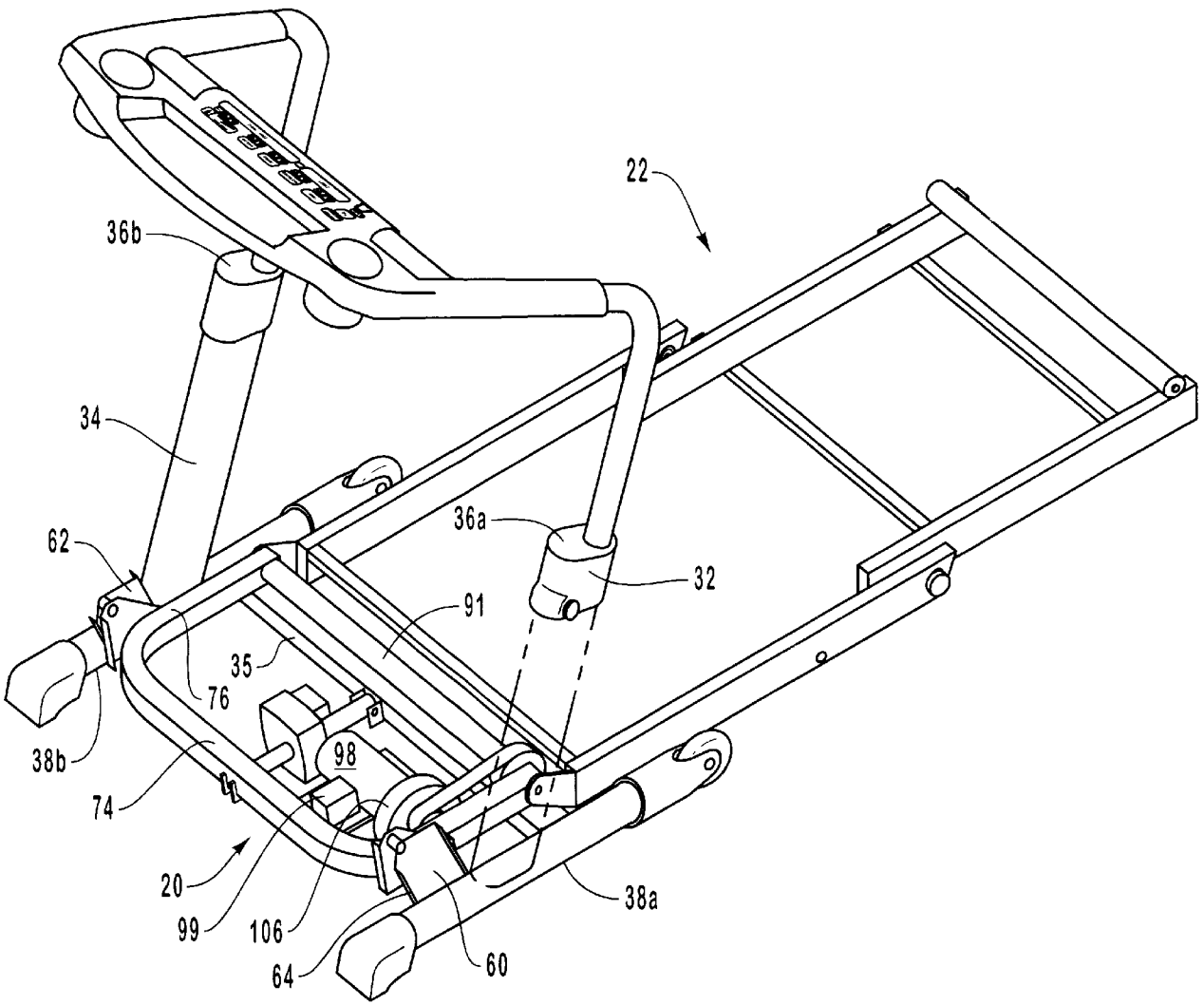
FIG. 4 illustrates a partial cut-away perspective view of portions of the treadmill of FIG. 1.
Figure 5:
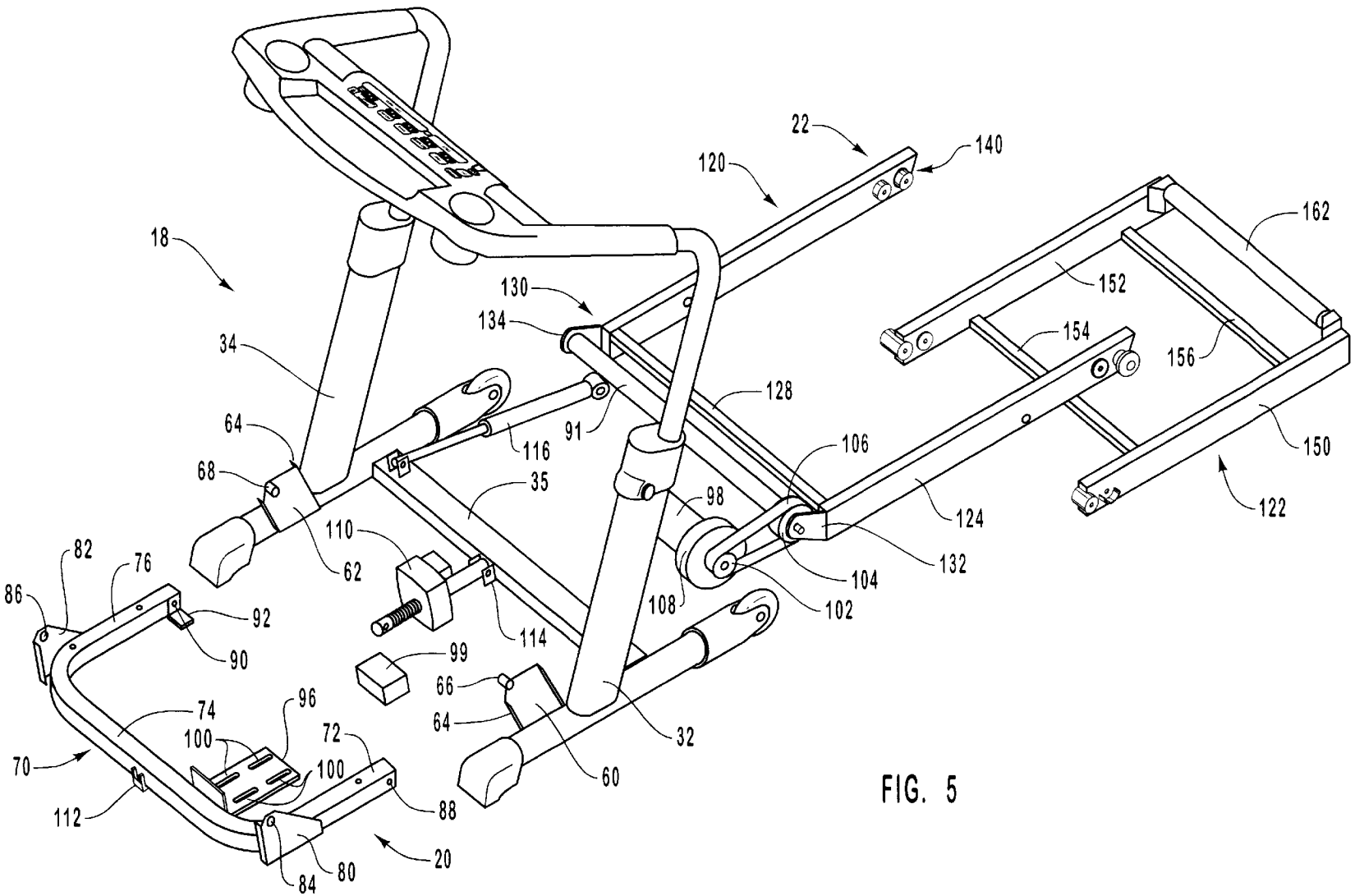
FIG. 5 illustrates an exploded perspective representation of the treadmill of FIG. 1.

Referring now to FIGS. 4 and 5, each side member 32, 34 of support assembly 18 includes a pivot flange 60, 62, extending from the respective second end 38 thereof. Each pivot flange 60, 62 is configured to support motion assembly 20, which inclines tread base 22 during use of treadmill 12. Each pivot flange 60, 62 has a generally planar configuration with one or more side strengthening flanges 64 to provide the strength and rigidity to support to motion assembly 20 and tread base 22.

Each pivot flange 60, 62 includes a pin 66, 68, adapted to allow pivotal coupling of motion assembly 20 thereto, as will be discussed herein. In this manner, motion assembly 20, or a portion thereof, can pivot about an axis extending through pins 66, 68.

One reasonably skilled in the art can identify various other configurations of pivot flange 60, 62 that are capable of performing the desired function. For instance, each flange 60, 62 can include strengthening indentations to provide the appropriate strength. In still another configuration, flange 60 and/or 62 is a tubular member having the requisite strength and rigidity without the aid of strengthening flanges 64. In still another configuration, each pin 66, 68 can be substituted for an aperture that engages with complementary pins found in motion assembly 20.

Generally, side members 32, 34 and flanges 60, 62 can have various configurations and can be fabricated from various materials. For example, the elements of support assembly 18 can be fabricated from, but not limited to metals, plastics, composites, combinations thereof, or the like, for example.

Preferably forming part of support assembly 18 is motion assembly 20. Although discussion is made herein to motion assembly 20 being part of support assembly 18, one reasonably skilled in the art can appreciate in light of this disclosure that motion assembly 20 can be separate and distinct from support assembly 18. Consequently, it can be understood that a support structure of treadmill 12 that supports a tread base of treadmill 12 may comprise support assembly 18 with or without motion assembly 20.

As mentioned above, motion assembly 20 can cause belt 24 (FIG. 1) of tread base 22 to rotate, while optionally varying the inclination or angular orientation of tread base 22 relative to the surface upon which the distal end of tread base 22 rests. Specifically, since motion assembly 20 is pivotally connected to pivot flanges 60, 62 extending from second end 38*a*, 38*b* of side members 32, 34, motion assembly 20 can incline or decline tread base 22.

Motion assembly 20, in one embodiment includes an incline member 70. Incline member 70 has a generally U-shaped configuration, with a first leg 72, a second leg 76, and an intermediate portion 74 between first leg 72 and second leg 76. As more clearly seen in FIG. 5, proximal to the junctions of first leg 72 and second leg 76 with intermediate portion 74 are pivoting flanges 80, 82. Each pivoting flange 80, 82 includes apertures 84, 86, respectively, which mate or engage with the corresponding pins 66, 68 in complementary pivot flanges 60, 62 coupled to side members 32, 34. In this manner, incline member 70 is pivotally coupled to side members 32, 34 of support assembly 18.

As further illustrated in FIG. 5, disposed through first leg 72 and second leg 76 are holes 88, 90 respectively, adapted to cooperate with tread base 22 and allow pivotal motion of tread base 22 with respect to incline member 70. Holes 88, 90 accommodate a front roller 91 (e.g., by receiving pins coupled to the roller therein) that rotates belt 24 (FIG. 1) of treadmill 12. To aid supporting front roller 91, second leg 76 optionally can include a mounting flange 92. Although only a single mounting flange 92 is depicted, one skilled in the art can appreciate that a similar mounting flange can be formed on first leg 72.

Incline member 70 can include a motor bracket 96 connected to intermediate portion 74. Motor bracket 96 has a generally L-shaped configuration and accommodates an electric drive motor 98 that is used to rotate front roller 91 during use of treadmill 12. Consequently, motor bracket 96 includes one or more apertures 100 that allow one or more fasteners (not shown) to connect or couple drive motor 98 to incline member 70, whether or not such coupling is fixed or releasable. For instance, such fasteners can include, but are not limited to nuts and bolts, screws, and the like. Optionally, adhesives or other similar bonding materials can be used to connect or couple drive motor 98 to incline member 70. Drive motor 98 is mechanically coupled to front roller 91 by way of pulleys 102 and 104 and a drive belt 106. In this illustrative embodiment, drive motor 98 further incorporates an inertial flywheel 108 that controls fluctuations in the rotational motion of a shaft of motor 98 during operation of treadmill 12. Optionally connected to drive motor 98 is a treadmill controller 99 that controls the operation of drive motor 98, and thus the speed of treadmill 12, in response to various user inputs or other control signals. Treadmill controller 99 is separate from motor 98; however, it can be appreciated by one skilled in the art that treadmill controller 99 can be incorporated within motor 98, motion assembly 20, console 14, or the like, for example.

In addition to the ability to control and vary the speed of belt 24, treadmill 12 also permits changes in the inclination of tread base 22 relative to the surface upon which tread base 22 is resting. Typically, this is accomplished using an incline drive motor 110 that rises or lowers one end of tread base 22 relative to the other end. Incline drive motor 110, in this illustrative configuration, is connected between intermediate portion 74 of incline member 70 and cross member 35 of support structure 18. More specifically, one end of incline motor 110 connects to a bracket 112 on member 70, while the other end of incline motor 110 connects to a bracket 114 on cross member 35. The particular configuration of brackets 112, 114 can vary as known by one skilled in the art, so long as brackets 112, 114 allow incline motor 110 to be connected or coupled thereto.

Figure 12:
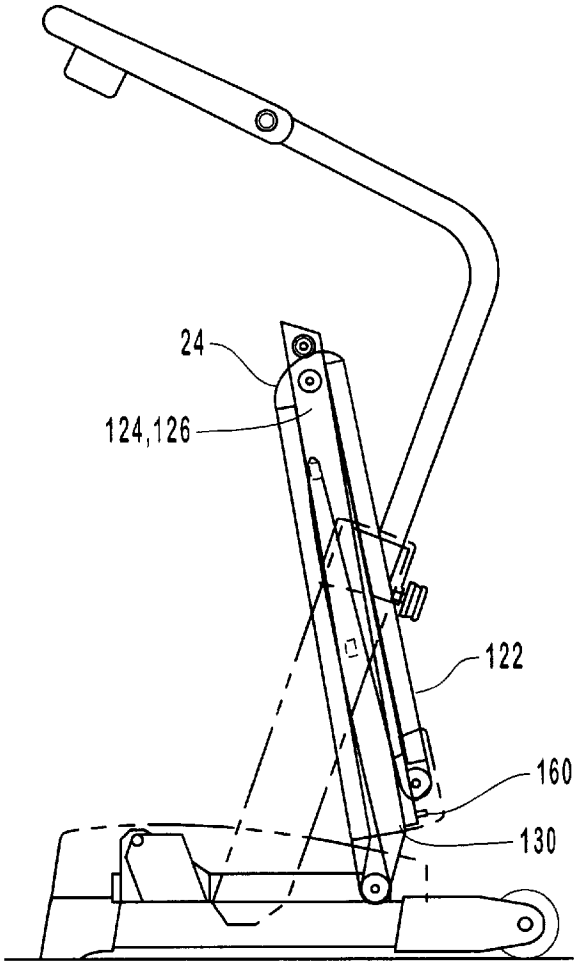
FIG. 12 illustrates the treadmill of FIGS. 1–11 in a completely folded position.

Connected between cross member 35 and tread base 22 is a lift assist mechanism 116. The lift assist mechanism 116 is preferably a gas cylinder that can continuously urge tread base 22 from the operating position (FIG. 1) toward a storage position (FIGS. 2 and 12). In one embodiment, lift assist mechanism 116 is a gas cylinder. The gas cylinder exerts a torque that can be selected to be less than the torque of the gravitational force exerted on tread base 22 when it is moved out of the stored position and is moved toward the operating position. Similarly, the torque of the gas cylinder can be less than the torque of the gravitational force of tread base 22 when it is being moved from the operating position toward the storage position. In other words, in one illustrative configuration, the force of the gas cylinder can be selected so that it may deliver sufficient torque in foot pounds of rotational force (based on its displacement from the axis of rotation) to overcome or exceed the torque attributable to gravitational forces so that tread base 22 will always automatically return to the upright position. However, it is preferred that the torque delivered by the gas cylinder be less than the torque from the gravitational force so that the tread base will not automatically return from the operating position to the storage position.

The lift assist mechanism is one structure capable of performing the function of lift assist means for assisting with the orientation of the tread base from an operating position to a storage position. Although the above discussion suggests various configurations of lift assist mechanisms 116 and hence lift assist means, one reasonably skilled in the art can identify various other configurations of lift assist mechanism 116 and lift assist means in light of this disclosure. For example, in another configuration, lift assist mechanism 116 and lift assist means can include one or more springs or other mechanical, pneumatic, hydraulic or electrical mechanisms and components to aid a user with moving tread base 22 from the operating position to the storage position, and optionally vice versa. In another configuration, lift assist mechanism 116 and lift assist means can include a solid or a liquid that acts to cause the requisite force or torque to aid a user with moving tread base 22 from the operating position to the storage position, and optionally vice versa. In still other configuration, lift assist mechanism 116 and lift assist means can include a combination of a gas, a liquid, and a solid to create the torque to aid a user with moving tread base 22. In yet another configuration, lift assist mechanism 116 and lift assist means can be a combination of another of the above.

Figure 6:
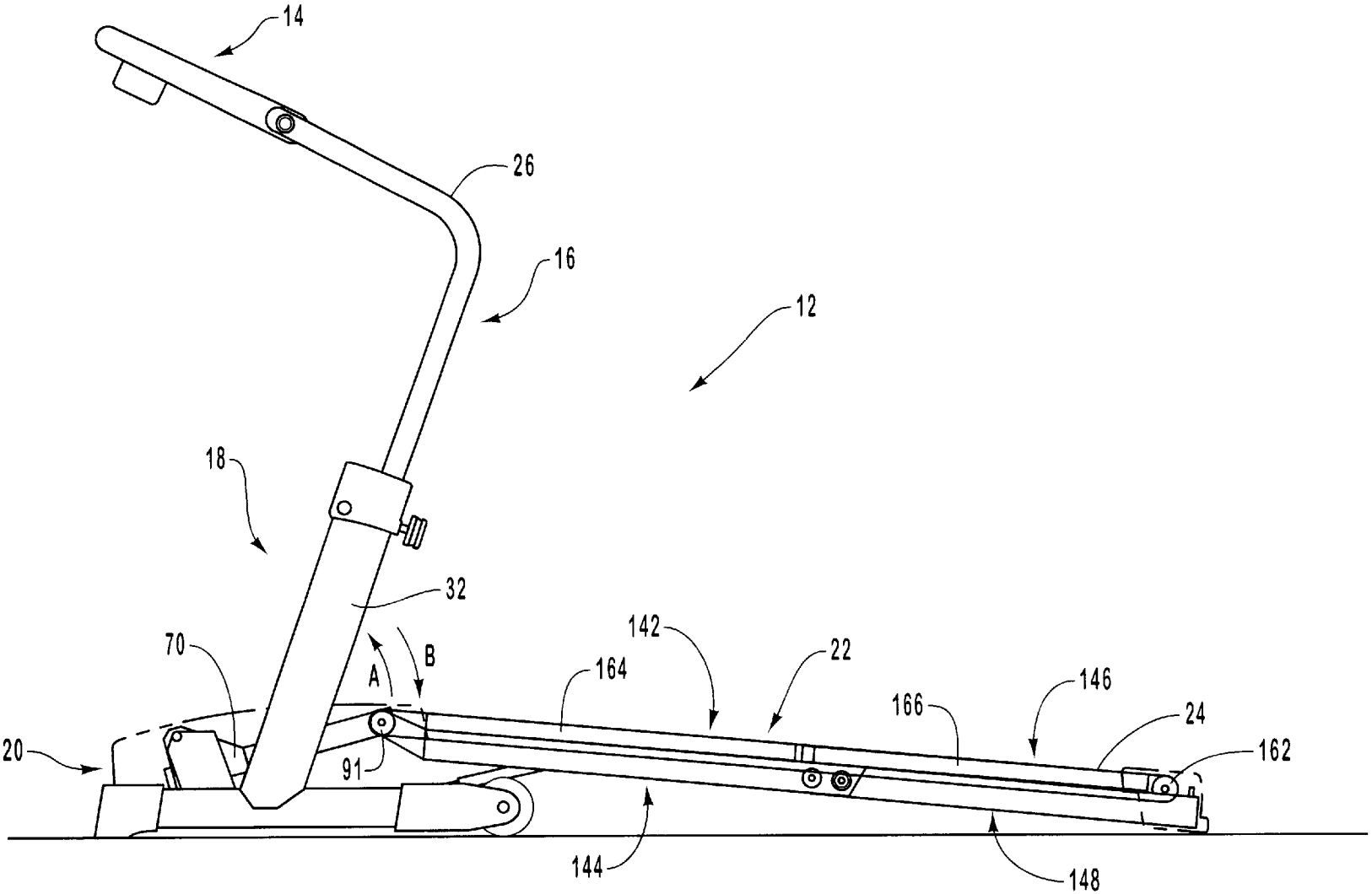
FIG. 6 illustrates a side view of the treadmill of FIG. 1 with the tread base in the inclined position.

With reference to FIGS. 5 and 6, since cross member 35 is fixed to side members 32, 34 and consequently fixed relative to incline member 70, upon activation of incline drive motor 110, the distal ends of first and second legs 72, 76 of incline member 70 move upwardly away from the surface upon which treadmill 12 is resting, as shown by arrow A. Hence, tread base 22 is raised, thereby requiring the exercising user to exercise harder during the exercise workout that would be necessary if tread base 22 is in the lowered or declined position. Alternatively, when incline drive motor 110 is deactivated or manipulated to cause a decline in the orientation of tread base 22, the distal ends of first and second legs 72, 76 move towards the surface upon which treadmill 12 is resting, as shown by arrow B. Consequently, tread base 22 returns to a substantially horizontal position that provides the user with an easier exercise workout than when tread base 22 is in the inclined position, as shown in FIGS. 1 and 4.

One skilled in the art can identify various other configuration or manners to raise one or both ends of tread base 22. For example, in another alternate configuration, tread base 22 can include a pair of rear feet that are rotatably attached to the distal end of tread base 22. These rear feet can be drawn toward the proximal end of tread base 22 as a flexible belt is wrapped around a flywheel or shaft of an alternate embodiment of incline drive motor. When the incline drive motor is reversed, the application of the force of gravity to tread base 22 returns tread base 22 to the original orientation of tread base 22.

Figure 7:
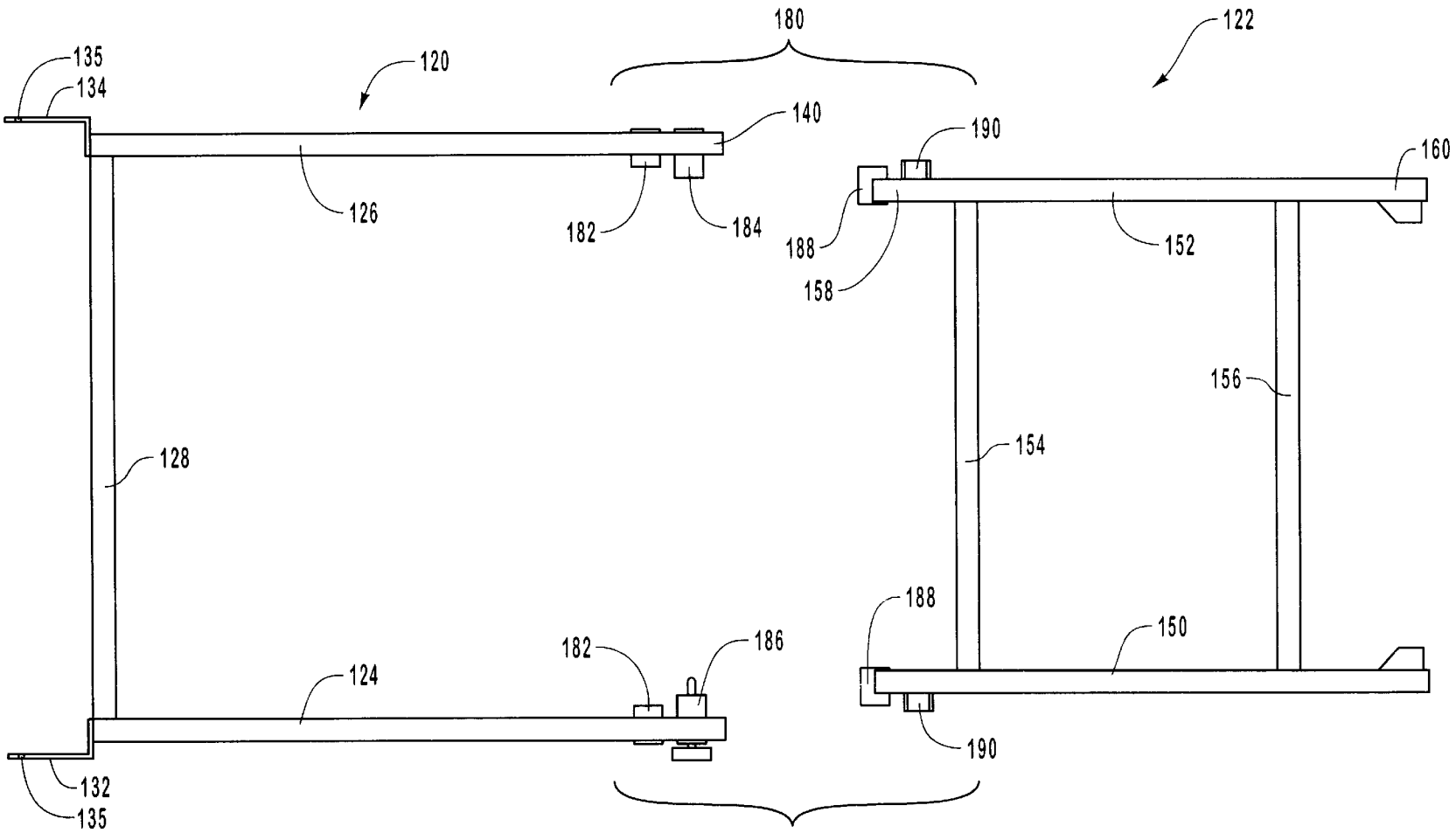
FIG. 7 illustrates a partial plan view of a front portion and a rear portion of the tread base of the treadmill of FIG. 1.

Referring now to FIG. 7, an illustrative configuration of tread base 22 is depicted. As shown, tread base 22 has a front portion 120 and a rear portion 122. The front portion 120 is proximal to support structure 18 when tread base 22 is in an operating position, while rear portion 122 is distal to support structure 18 when tread base is in the operational position. Front portion 120 includes a pair of side rails 124, 126 connected by a cross member 128. The proximal end 130 of each side rail 124, 126 is formed with mounting flanges 132, 134 that are configured to rotatably mount tread base 22 to motion assembly 20, while securely retaining front roller 91 therebetween, as shown in FIG. 4. Specifically, each mounting flange 132, 134 includes a hole 135 within which mounts front roller 91. Front roller 91 is coupled to motion assembly 20. The distal end 140 of each side rail 124, 126 is configured to rotatable mount to rear portion 122, as will be discussed in detail hereinafter.

Figure 8:
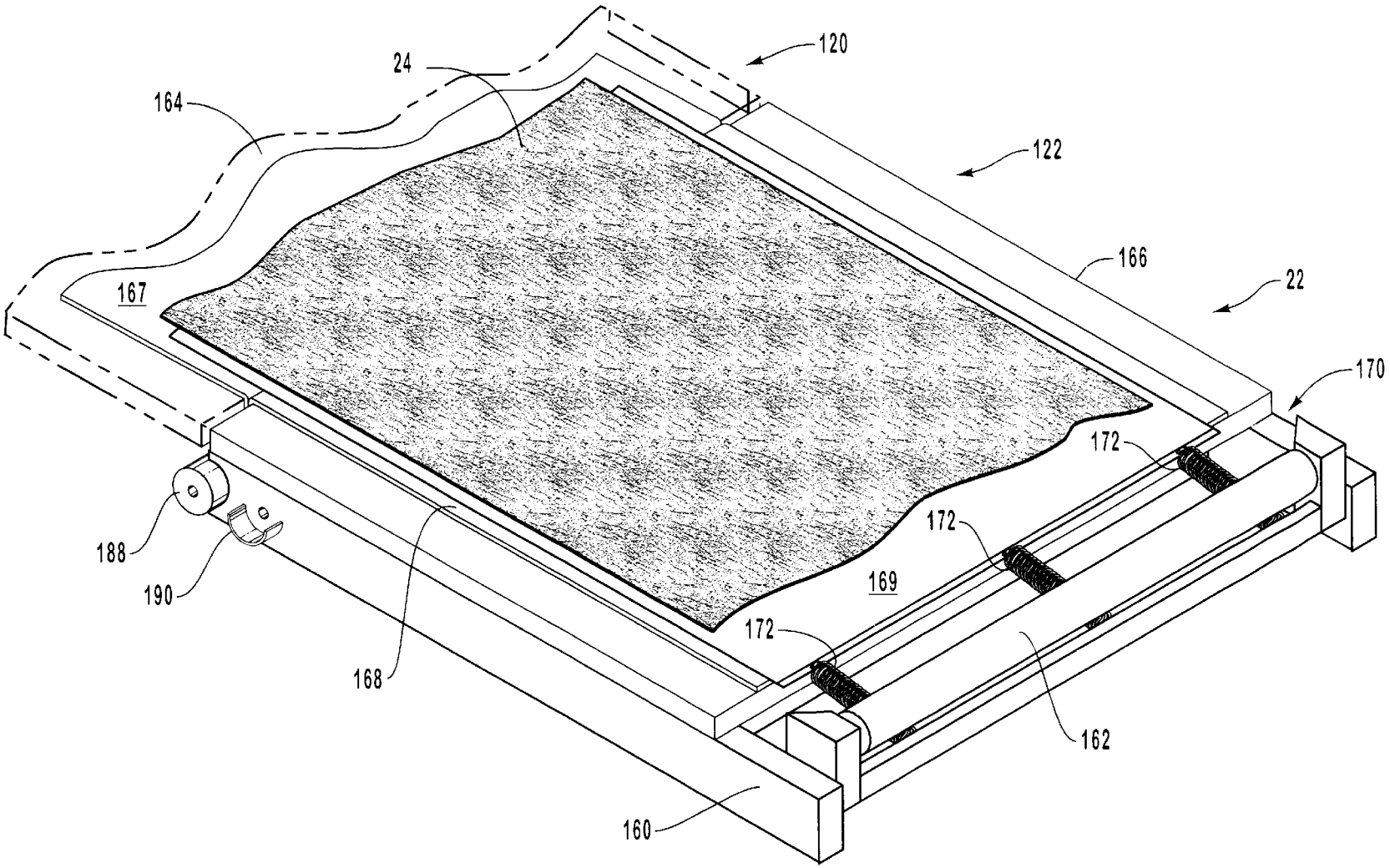
FIG. 8 illustrates a cutaway, plan view of the tread base of the treadmill of FIG. 1.

Rear portion 122 also includes a pair of side rails 150, 152. These side rails 150, 152 are separated by two cross members 154, 156 spaced between a proximal end 158 and a distal end 160 of each side rail 150, 152. A rear roller 162 is disposed between side rails 150, 152 at distal end 160 thereof, as shown in FIG. 8. The continuous belt 24 extends between and around front and rear rollers 91, and 162 respectively, as shown in FIGS. 5, 6, and 8. Consequently, belt 24 passes over upper surfaces 142, 146 of front portion 120 and rear portion 122 respectively, beneath lower surface 144 of front portion 120, and over upper surfaces of cross members 154, 156 of rear portion 122, as shown in FIGS. 2 and 6. Alternatively, belt 24 can pass beneath the lower surface of cross member 154, while passing over the upper surface of cross member 156, or vise versa, for example. In this manner, cross members 154, 156 retain belt 24 during folding and unfolding of tread base 12, which will be discussed in more detail hereinafter.

Generally, rollers 91, 162 and belt 24 can have various configurations and be fabricated from various materials, as known by one reasonably skilled in the art and commonly known within the exercise industry. Similarly, the elements of front portion 120 and rear portion 122 can have various configurations and can be fabricated from various materials. For example, the elements of support assembly 18 can be fabricated from, but not limited to metals, plastics, composites, combinations thereof, or the like, for example.

To support belt 24 and consequently an exercising user, as shown in FIGS. 2 and 6, each portion 120, 122 includes a respective deck 164, 166. Commonly, each deck 164, 166 is fabricated from a cellulose material such as wood; although various other types of material can be used so long as each deck 164, 166 is capable of supporting belt 24 and a user exercising thereupon.

Referring now to FIG. 8, disposed between belt 24 and each deck 164, 166 is a pad 167, 168 respectively. Each pad 167, 168 is coupled to the respective deck 164, 166, such as through an adhesive for instance, and is configured to provide cushioning to a user exercising upon tread base 22. These pads 167, 168 can optionally wrap around the proximal and distal ends of each deck 164, 166, attach only to the top portion of each deck 164, 166, or attach to each deck 164, 166 in some other configuration known to one skilled in the art. Additionally, pad 167, 168 can optionally be fixably or releasably attached to each deck 164, 166.

In addition, various types of pad 167, 168 can be used to cushion the user as they exercise upon treadmill 12. For example, in one configuration, pad 167, 168 can be a foam-type pad, a gel-type pad, or the like.

Extending from proximal end 130 (FIG. 5) of front portion 120 to distal end 160 of rear portion 122 of tread base 22 is a friction reducing pad 169. This friction reducing pad 169, typically fabricated from Mylar®, provides a slippery surface upon which belt 24 can slide as it rotates about roller 91 (FIG. 5) and 162. One reasonably skilled in the art can identify various other configurations or materials that can be used as friction reducing pad 169, so long as they aid in achieving a substantially frictionless surface upon which belt 24 can move during performance of an exercise program by the user of treadmill 12.

As illustrated, friction reducing pad 169 is fixed at proximal end 130 of front portion 120, while friction reducing pad 169 is mounted to distal end 160 of rear portion 122 via a spring mechanism 170. Spring mechanism 170, that has the form of one or more springs 172, allows movement of friction reducing pad 169 during folding of tread base 22 as will be described in detail hereinafter.

It can be appreciated by one skilled in the art that various other configurations are known by which friction reducing pad 169 is allowed to move to some degree during folding of tread base 22. For example, instead of being fixed at proximal end 130 of front portion 120, friction reducing pad 169 can be fixed at distal end 160 of rear portion 122, while friction reducing pad 169 is mounted to proximal end 130 of front portion 120 by the spring mechanism 170. In another configuration, spring mechanism 170 takes the form of a plurality of elastic members or other similar structures that allow friction reducing pad 160 to move during folding of tread base 22 as discussed herein.

In addition to the above-described configurations, one reasonably skilled in the art can identify various other manners by which a substantially frictionless surface is provided upon which belt 24 can move. For example, in another configuration, each deck 164, 166 individually includes a friction reducing material that extends from a proximal end to a distal end thereof, rather than including a single piece of friction reducing material that extends from a proximal end of deck 164 to terminate substantially at the distal end of deck 166. In another configuration, each deck 164, 166 is individually wrapped with a friction reducing material, such as Mylar®. Generally, therefore, the term "pad" as used herein can reference pad 167, 168 alone, friction reducing pad 169 alone, or any combination of pad 167, 168 and/or friction reducing pad 169.

Referring again to FIG. 7, disposed at a distal end 140 of front portion 120 and a proximal end 158 of rear portion 122 is a folding mechanism 180. Folding mechanism 180 is configured to allow front portion 120 and rear portion 122 to releasably engage to create a substantially flat tread base when tread base 22 is in the downward operating position, as shown in FIG. 1. Consequently, folding mechanism 180 assists with positioning front portion 120 and rear portion 122 into a substantially planar relationship one with another as shown in FIG. 6. Stated another way, folding mechanism 120 helps to cause upper surfaces 142, 146 of front portion 120 and rear portion 122 respectively, to lie in substantially the same plane when tread base 22 is either in the operating position, see FIG. 6, or when tread base 22 is in the storage position typically used by re-orientating or folding treadmills, as illustrated in FIG. 2.

In addition to the above, folding mechanism 180 allows tread base 22 to fold into two or more sections, thereby allowing tread base 22 to reduce its overall length and consequently reduce the limiting dimension of treadmill 12 for both storage and shipping. Although discussion is made to folding or splitting tread base 22 into two portions, i.e., front portion 120 and rear portion 122, one reasonably skilled in the art can appreciate that tread base 22 can be split into more than two portions and use a plurality of folding mechanisms 120 to reduce the overall length of tread base 22.

Folding mechanism 180, in one illustrative configuration includes various members, spring latches, and stops formed on front portion 120 and/or rear portion 122. More specifically, the distal end 140 of front portion 120 includes two pivot members 182, a spacer member 184, and a spring latch 186, while proximal end 158 of rear portion 122 includes two pivot members 188 and two stops 190.

The following discussion will focus on the manner by which side rail 124 and side rail 150 engage one with another via a portion of folding mechanism 180. It can be appreciated that such a discussion is only illustrative of one manner by which side rails 124, 126, 150, and 152 engage one with another. Further, a similar discussion can be made with respect to the manner by which side rails 126, 152 can engage one with another.

Figure 10:
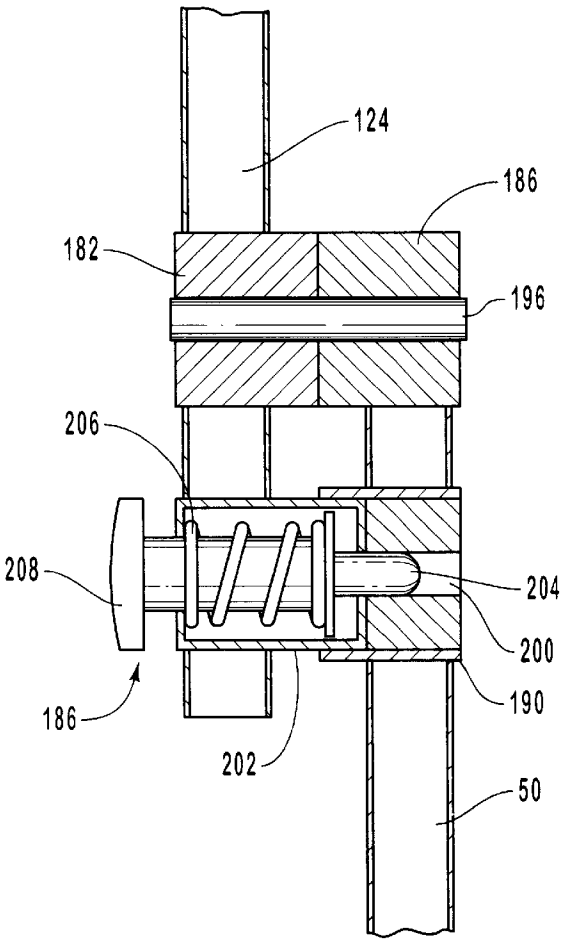
FIG. 10 illustrates a cross-sectional side view of the folding mechanism of the tread base of treadmill of FIG. 1.
Figure 9:
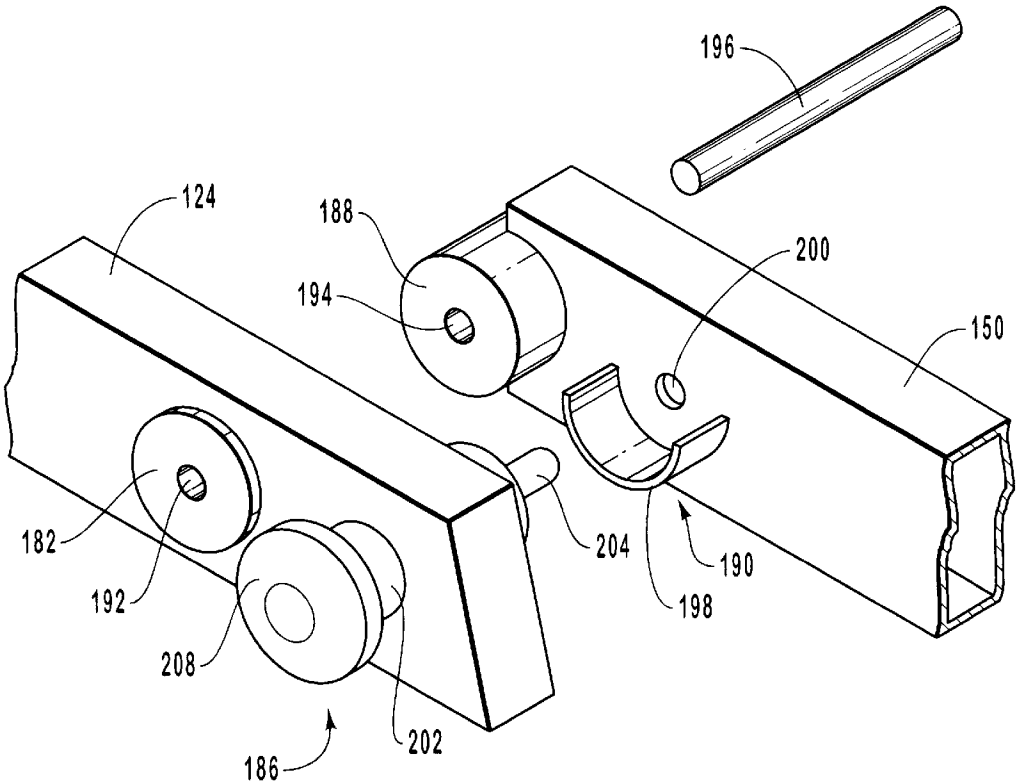
FIG. 9 illustrates an exploded perspective view of the folding mechanism coupled to the tread base of the treadmill of FIG. 1.

Referring now to FIGS. 7, 9 and 10, each pivot member 182, 188 includes a hole 192, 194 respectively that passes through substantially the entire length of members 182, 188. Optionally, holes 192, 194 can extend only partially through members 182, 188. These holes 192, 194 accommodate a pivot pin 196 that defines the pivotal axis about which rear portion 122 pivots with respect to front portion 120. One pivot pin 196 may join side rails 124, 150 together, while another pin joins side rails 125, 152 together. The combination of pivot members 182 and 188 with pins 196 is one structure capable of performing the function of means for pivoting a second portion substantially about the distal end of the first portion.

One reasonably skilled in the art in light can identify various other configurations of such means. For instance, optionally a single elongated pin can extend from side rails 124, 150 to side rails 126, 152 to define the pivotal axis.

In close proximity to pivot members 182, 188 is spring latch 186. Spring latch 186 includes a housing 202 that retains a pin 204 biased by a spring 206. The pin 204 is connected to a head 208 that can be manipulated by the user to overcome the biasing force of spring 206 and consequently release engagement of pin 204 from within a complementary hole 200 formed in stop 190. For instance, the user can hold head 208 and draw pin 204 into housing 202, to thereby release engagement with hole 200. Once head 208 is released the biasing force of spring 206 returns pin 204 to the extended position.

Spring latch 186 is one example of structure capable of performing the function of means for releasably maintaining the second portion in a substantially planar relationship to the first portion when the tread base is in the operating position. One reasonably skilled in the art can identify various other configurations of such means. Illustratively, and not by way of limitation, in another configuration a non-biased removably pin could be substituted for spring latch 186. In still another configuration, a ball plunger may be used to place the front and rear portion in substantial planar relationship.

Thus, as illustrated in FIGS. 7, 9, and 10, front portion 120 includes spring latch 186 formed on side rail 124. Substantially opposite to spring latch 186 on side rail 126 is spacer member 184 (FIG. 7). Spacer member 184 has a similar configuration to housing 202 of spring latch 186. Consequently, spacer member 184 acts as a guide to side rails 126, 152 during use of treadmill 12. Further, spacer 184 provides a member with which stop 190 or rail 152 can mate during folding of tread base 22 to thereby prevent over rotation of rear portion 122 with respect to first portion 120.

Mounted on side rails 150, 152 of rear portion 122 are two respective stops 190 (FIG. 7). Each stop 190 has a generally U-shaped or semicircular shaped member 198 with an adjacent hole 200. The member 198 (FIG. 9) extends outwardly towards front portion 120 when front portion 120 and rear portion 122 are connected together. Consequently, member 198 of each stop 190 mates with either housing 202 of spring latch 186 or spacer member 184 when front portion 120 and rear portion 122 are in substantial planar relationship one with another.

Stop 190 is one structure capable of performing the function of means for preventing over rotation of the rear portion, i.e., second portion relative to or substantially about the front portion, i.e., first portion as the rear portion pivots. It can be appreciated by one skilled in the art that the particular configuration of stop 190 can vary so long as each stop 190 is capable of mating with spring latch 186 and/or spacer member 184 to prevent over rotation of rear portion 122 relative to front portion.

Generally, the various components of folding mechanism 180 can have various configurations and be fabricated from various types of materials so long as the are capable of performing the function of assisting with the folding of tread base 22.

Following hereinafter is a discussion of the operation or manner by which tread base 22 is folded such that the length of tread base 22 is no longer the limiting factor in the space required for transporting or shipping treadmill 12. The following description is illustrative of only one particular manner or method for folding tread base 22. It can be understood that one skilled in the art can identify various other manners or methods by which tread base 22 can be folded or collapsed to a smaller configuration.

Initially, as shown in FIG. 1 tread base 22 is in the downward operating position. The present invention allows tread base 22 to be optionally placed into a first storage position, similar to that typically achievable with conventional re-orientating or folding treadmills as illustrated in FIG. 2 or a second storage position where tread base 22 is split and folded to cause lower surfaces 144, 148 of front portion 120 and rear portion 122 to become substantially adjacent one to another as shown in FIG. 12.

With reference to FIGS. 1, 2 and 5, in the first situation, upon a user wishing to place tread base 22 into the first storage position, the user grasps distal end 160 of rear portion 122 and rotates tread base 22 about the pivot point defined by the central axis of front roller 91. The user can be aided in rotating tread base 22 into the storage position through use of lift assist mechanism 116 or other means for assisting with the orientation of the tread base from the operating position to the first storage position.

When tread base 22 reaches the storage position, tread base 22 can rest upon handrail 16 or console 14. Alternatively, the lift assist means can support and retain tread base 22 in the storage position. Optionally, as shown in FIG. 2, one or both side members 32, 34 can include a latching mechanism 212 that securely retains tread base 22 in the storage position. The latching mechanism 212 can have a similar configuration to spring latch 186, where a pin 214 extends from side member 32 to engage with a complementary hole 216 formed in tread base 22 and securely fix tread base 22 in the storage position.

It can be understood by one skilled in the art that various other latching mechanisms are appropriate in view of the teaching contained herein. For instance, latching mechanism 212 can take the form of locking mechanism 42. In another configuration, treadmill 12 includes two latching mechanisms, one engaging with side rail 124, while a second engages with side rail 126. In still another configuration, a latching mechanism mates with side rail 150 or 152 of tread base 22.

To reposition tread base 22 in the operating position, the user can release latching mechanism 212 and consequently rotate tread base 22 downwardly.

Figure 11:
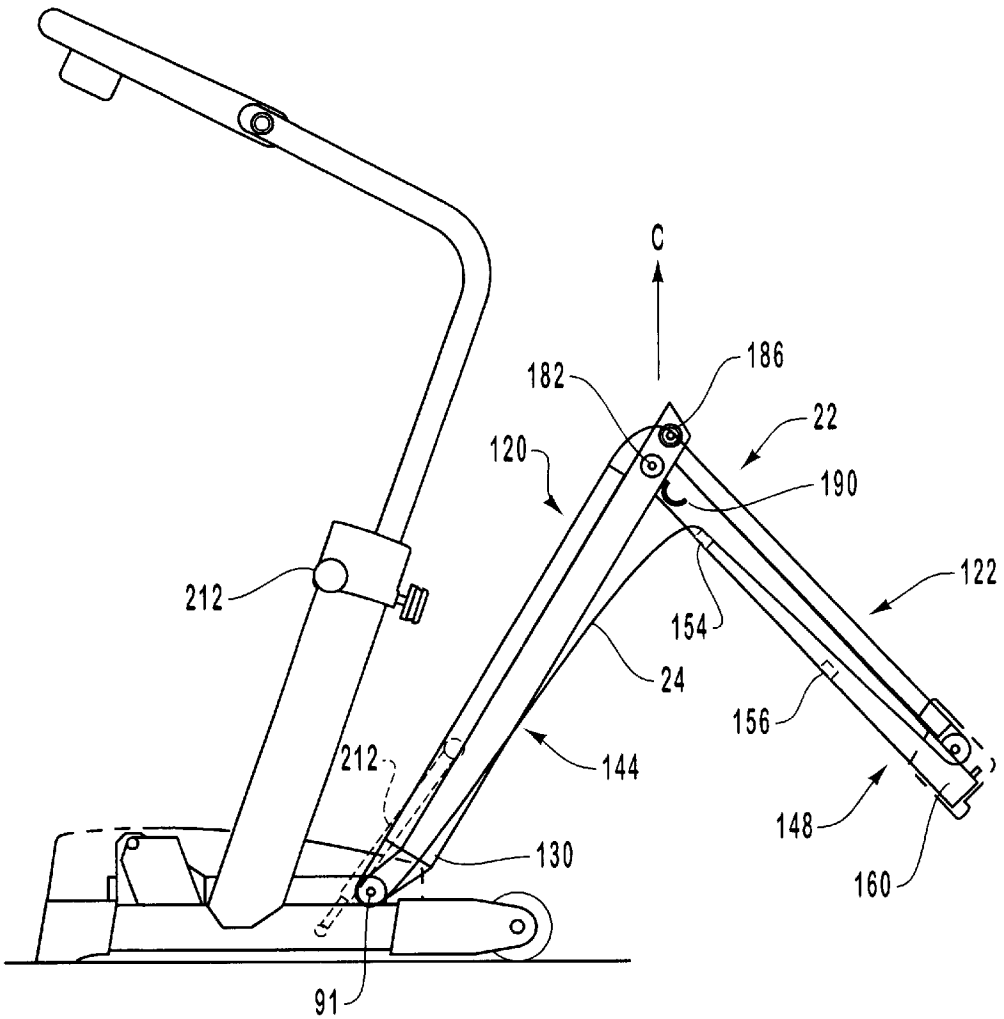
FIG. 11 illustrates the treadmill of FIGS. 1–10 in a partially folded position.

Turning now to FIGS. 11 and 12, the illustrative manner by which tread base 22 is placed into the second storage position is depicted. A user initially releases the engagement of spring latch 186 with hole 200 of stop 190 by pulling head 208 and moving pin 204 from within hole 200. Following the release of spring latch 186, a user moves the junction of front portion 120 and rear portion 122 upwardly, as represented by the arrow with reference to letter C. In one embodiment, due to the tension in belt 24, front portion and rear portion 122 remain engaged until the upward force applied to the junction of front portion 120 and rear portion 122 is sufficient to overcome the forces applied by the tension of belt 24 to maintain front portion 120 and rear portion 122 in substantial planar relationship one to another. Such tension forces can be sufficiently great that front portion 120 and rear portion 122 are maintained in substantial planar relationship without spring latch 186 engaging with hole 200.

Once the forces applied by the tension of belt 24 are overcome, rear portion 122 can pivot about the axis defined by pivot members 182, 188. As rear portion 122 pivots about pivot members 182, 188, belt 24 is retained in place by cross members 154, 156 of rear portion 122. Consequently, belt 24 is prevented from folding during pivoting of rear portion 122 and becoming damaged by entangling with portions of front portion 120. Similarly, spring mechanism 170 coupled to pad 168, as shown in FIG. 7, allows pad 168 to move, thereby preventing damage to pad 168 from stretching of pad 168 during the folding process.

As rear portion 122 pivots about pivot members 182, 188 front portion 120 is rotated about front roller 91 in a similar manner as that described with respect to positioning tread base 22 in the first storage position. For instance, tread base 22 can include a lift assist mechanism or means to aid the user with moving tread base 22 from the operating position to the second storage position.

The pivoting of front portion 120 and rear portion 122 can continue until lower surfaces 144, 148 are substantially adjacent one to another. As shown in FIG. 12, since the width of rear portion 122 can be smaller than the width of front portion 120, rear portion 122 can fit within the space between side rails 124, 126 of front portion 120 when the folding process is completed. Although this is preferred, it can be appreciated by one reasonably skilled in the art in light of this disclosure that the present invention need not require that rear portion 122 fit within the above-defined space of front portion 120.

Upon reaching the second storage position, as illustrated in FIG. 12, front portion 120 and rear portion 122 can be retained in place through use of latching mechanism 212. In this configuration, latching mechanism 212 can extend through one or both side rails 124, 150 and/or 126, 152 to maintain tread base 22 in the storage position. For instance, one latching mechanism 212 can extend through side rail 124 and optionally into side rail 150, while another optional latching mechanism 212 can extend through side rail 126 and optionally into side rail 152. Instead of using latching mechanism 212, front portion 120 and rear portion 122 can remain in the second storage position through only the influence or effect of gravity.

To place tread base 22 into the operating position from the second storage position, a user can release latching mechanism 212 or merely grab or hold distal end 160 of rear portion 122 of tread base 22. The user can draw distal end 160 of rear portion 122 away from proximal end 130 of front portion 120. The user continues to separate distal end 160 and proximal end 130 until stops 190 are adjacent to housing 202 of spring latch 186 and spacer member 184 (FIG. 10). The tension of belt 24, in one configuration, prevents stops 190 from engaging with respective housing 202 and spacer member 184 until the user forces stops 190 into contact with respective housing 202 and spacer member 184. Subsequently, the tension of belt 24 retains stops 190 in substantial contact with respective housing 202 and spacer member 184. In this manner, the tension of belt 24 can act as a safety feature that prevents front portion 120 and rear portion 122 from becoming disengaged one form the other.

Once stops 190 mate or engage with respective housing 202 and spacer member 184 the user can insert pin 204 of spring latch 186 into hole 200 to secure front portion 120 to rear portion 122, as shown in FIG. 10. Consequently, treadmill 12 is configured to allow a user to exercise thereupon.

Although the figures shown demonstrate that folding the tread base alters the length of the tread base, in another embodiment of the present invention, the tread base length is selectively altered through the use of a telescoping tread base that has a first extended length and a second compressed length that is shorter than the first length. In one such embodiment, the telescoping mechanism can include a tube in tube assembly, for example, although a number of other mechanisms may be used such as a sliding assembly, a threading assembly, or a variety of other assemblies that enable the length of the tread base to be shortened. In some sliding type telescoping tread bases, the belt may be tensioned following or during adjustment. Consequently, one reasonably skilled in the art can identify various tread bases and manners to tension the belt, if needed, in light of the teaching contained herein.

Also as described above, the handrail of the present invention is advantageously a telescoping assembly. The telescoping handrail of the present invention can include first and second telescoping uprights or members, as shown, or a center telescoping member or a variety of different telescoping mechanisms. Further, the telescoping mechanisms can have incremental positions, as shown. Therefore, a variety of different telescoping handrails can be employed in the present invention.

In addition, although the figures show the treadmill as being coupled at a proximal end thereof to the support structure, it is also within the scope of this invention to pivot the tread base about a pivot point located at any position between the proximal end of the front portion and the distal end of the rear portion of the tread base. For example, the front portion of the tread base can be pivotally coupled to the support structure between the proximal end and the distal end of the front portion of the tread base.

Further, it can be appreciated by one reasonably skilled in the art in light of the teaching contained herein that tread base need not be pivotally coupled to the motion assembly or to second end of the side members. Instead, the tread base of the present invention can be coupled in any location between the first end and the second end of the side members or to the handrail. In one such embodiment, folding of the foldable tread base can be achieved by raising the pivot point upward along the side members and/or the handrail such that the proximal end of the front portion of the folding tread base can move sufficiently downward so the tread base can fold. In this manner, the present invention can accommodate various different housings, pans, and the like that surround the drive motors and associated components, in addition to the incline drive motor and associated components, while providing the functionality of a folding treadmill that can reduce the amount of space required for storage or the size of packing container used to store and/or transport the treadmill.

According to another aspect of the present invention, and as implied above, the treadmill can include moveable arms coupled to the tread base and/or the side members of the support structure. As with the handrails, such moveable arms can be configured to telescope and thereby allow their overall length to be reduced as necessary. These moveable arms can be tensions to increase the amount of force required to move the arms back and forward during an exercise workout. In this manner, the inclusion of the moveable arms provides a mechanism that aids the user to obtain an anaerobic as well as an aerobic exercise workout through use of the treadmill of the present invention. Various types of moveable arm are known to those skilled in the art in light of the teaching contained herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A motorized treadmill, comprising:

(a) a support structure; and (b) a tread base, having a first end and a second end, supported by the support structure, the tread base comprising (i) a first portion pivotally supported by the support structure at the first end and (ii) a second portion movably mounted to the first portion at a location of the tread base between the first end and the second end of the tread base, the second portion being moveable relative to the first portion.

2. A treadmill as recited in claim 1, further comprising a handrail slidably engaged with a support member of the support structure.

3. A treadmill as recited in claim 1, further comprising means for locking the first portion to the second portion.

4. A treadmill as recited in claim 1, further comprising a folding mechanism coupled to at least one of the first portion and the second portion to aid with pivoting of the second portion relative to the first portion.

5. A treadmill as recited in claim 1, wherein the support structure comprises a motion assembly, the motion assembly configured to incline and decline the tread base.

6. A treadmill as recited in claim 5, wherein the first portion is coupled to the motion assembly.

7. A treadmill as recited in claim 1, wherein the tread base comprises (a) a front roller and a rear roller;

(b) a belt extending from the front roller and the rear roller; and (c) a first deck and a second deck configured to support the belt.

8. A treadmill as recited in claim 7, wherein the tread base comprises a pad extending from the first portion to the second portion, the pad being configured to reduce frictional forces applied to the belt as a user exercises upon the treadmill.

9. A treadmill as recited in claim 1, wherein the support structure comprises a telescoping handrail.

10. A treadmill as recited in claim 9, wherein the handrail comprises first and second telescoping uprights that selectively move between desired incremental positions.

11. A treadmill comprising:

(a) a support assembly; and (b) a tread base pivotally attached to the support assembly, the tread base being selectively moveable between (i) an operating position where the tread base has a first length defined by a distance between a first end and a second end of the tread base; and (ii) a storage position where the tread base has a second length between the first end and the second end, the second length being less than the first length.

12. A treadmill as recited in claim 11, wherein the support assembly comprises a handrail, wherein the handrail is configured to slidably engage with a support member of the support assembly and move between the first height and a second height, the second height being less than the first height.

13. A treadmill as recited in claim 11, wherein the tread base comprises a first portion pivotally mounted to a second portion.

14. A treadmill as recited in claim 11, wherein the support assembly comprises a support structure and a motion assembly.

15. A treadmill as recited in claim 14, wherein the motion assembly comprises an incline member and an incline motor the incline motor being coupled to the support structure and the incline member.

16. A treadmill as recited in claim 11, wherein the tread base comprises a locking mechanism coupled to the support assembly, the locking mechanism being configured to maintain the handrail at a selected position relative to a support member of the support assembly.

17. A treadmill as recited in claim 11, wherein the tread base comprises a first portion and a second portion pivotally attached to the first portion, further comprising a folding mechanism attached to the first portion and the second portion, the folding mechanism configured to rotatably couple the second portion to a distal end of the first portion.

18. A treadmill as recited in claim 17, wherein the folding mechanism comprises:

(a) means for pivoting the second portion substantially about the distal end of the first portion;

(b) means for preventing over rotation of the second portion substantially about the first portion as the second portion pivots; and (c) means for releasably maintaining the second portion in a substantially planar relationship to the first portion when the tread base is in the operating position.

19. A treadmill as recited in claim 18, wherein the means for pivoting comprises a first member formed in the first portion and a second member formed in the second member, the first member and the second member being coupled by a pivot pin.

20. A treadmill as recited in claim 18, wherein the means for preventing comprises a stop coupled to the second portion, the stop being configured to engage with the means for releasably maintaining the second portion when the first portion and the second portion are in substantial planar relationship.

21. A treadmill as recited in claim 18, wherein the means for releasably maintaining the second portion comprises a spring latch configured to engage with the second portion when the second portion and the first portion are in substantial planar relationship.

22. A treadmill as recited in claim 11, wherein the tread base comprise a pad extending from a first portion to a second portion.

23. A treadmill as recited in claim 22, wherein the pad is fixably attached to the tread base by a spring mechanism allowing the pad to move as the tread base moves from the operating position and the storage position.

24. A treadmill as recited in claim 11, wherein the tread base comprises a first portion and a second portion pivotally mounted to the first portion, the first portion comprises a proximal end and a distal end, the second portion being pivotally mounted at the distal end of the first portion.

25. A treadmill as recited in claim 24, wherein the first portion and the second portion comprise a first lower surface and a second lower surface, the second portion being configured to pivot about the distal end of the first surface such that the first lower surface is substantially adjacent the second lower surface.

26. A motorized treadmill, comprising:

(a) a support structure; and (b) a tread base pivotally coupled to the support structure, the tread base comprising:

(i) a front portion pivotal relative to the support structure; and (ii) a rear portion movably coupled to the front portion and movable relative to the front portion.

27. A treadmill as recited in claim 26, wherein the front portion and the rear portion comprise a front lower surface and a rear lower surface, the rear portion being configured to pivot about a distal end of the front portion such that the front lower surface is substantially adjacent to the rear lower surface.

28. A treadmill as recited in claim 26, wherein the support structure comprises a motion assembly and a handrail.

29. A treadmill as recited in claim 26, wherein the support structure comprises a telescoping handrail.

30. A treadmill comprising:

(a) a support structure; and (b) a tread base coupled to the support structure, the tread base being selectively oriented in:

(i) an operational position where the tread base has a first length defined by a distance between a first end and a second end of the tread base;

(ii) a first storage position; and (iii) a second storage position where the tread base has a second length that is different from the first length.

31. A treadmill as recited in claim 30, wherein:

(a) the support structure comprises a support member and a handrail; and (b) the tread base is pivotally coupled to the support structure, the tread base comprising:

(i) a front portion pivotally coupled to the support structure; and (ii) a rear portion pivotally coupled to the front portion.

32. A treadmill as recited in claim 30, wherein the front portion and the rear portion comprise a front lower surface and a rear lower surface, the rear portion being configured to pivot about a distal end of the front portion such that the front lower surface is substantially adjacent to the rear lower surface.

33. A treadmill as recited in claim 30, wherein the first length is the same length as the tread base in the operational position.

34. A treadmill as recited in claim 30, wherein the second length is smaller than the first length.

35. The treadmill as recited in claim 30, wherein the treadmill is motorized.

* * * * *

UNITED STATES PATENT AND TRADEMARK OFFICE

CERTIFICATE OF CORRECTION

PATENT NO. : 6,830,540 B2
APPLICATION NO. : 09/775309
DATED : December 14, 2004
INVENTOR(S) : Watterson et al.

It is certified that error appears in the above-identified patent and that said Letters Patent is hereby corrected as shown below:

Column 1,
Line 7, after "are capable of" change "folding," to --folding--
Line 43, change "In use a motorized," to --In order to use a motorized treadmill,--
Line 59, change "spas" to --spa--

Column 2,
Line 45, after "the present invention" remove "is"

Column 3,
Line 16, after "into two portions," change "So" to --so--
Line 53, after "support members" insert --,--

Column 5,
Line 45, after "support assembly 18" insert --,--
Line 49, before "support structure" insert --a--

Column 6,
Line 63, change "allows slidably engagement" to --allows slideable engagement--

Column 7,
Line 19, after "ball plunger 44" remove ","
Line 46, after "bore 40" change "can includes" to --can include--
Line 58, after "but not limited to" insert --,--

Column 8,
Line 1, before "motion assembly 20" remove "to"
Line 21, after "but not limited to" insert --,--
Line 41, after "in one embodiment" insert --,--

Column 9,
Line 7, after "not limited to" insert --,--
Line 27, after "drive motor 110" change "that rises" to --that raises--

Column 10,
Line 12, before "configuration," change "other" to --another--
Line 26, before "would be necessary" change "that" to --than--
Line 26, after "tread base 22" change "is" to --were--
Lines 36-37, change "configuration" to --configurations--
Line 62, after "configured to" change "rotatable" to --rotatably--

UNITED STATES PATENT AND TRADEMARK OFFICE

CERTIFICATE OF CORRECTION

PATENT NO. : 6,830,540 B2
APPLICATION NO. : 09/775309
DATED : December 14, 2004
INVENTOR(S) : Watterson et al.

It is certified that error appears in the above-identified patent and that said Letters Patent is hereby corrected as shown below:

Column 13,
Line 14, change "art in light" to --art, in light of the present invention,--
Line 27, after "is released" insert --,--
Line 29, after "one example of" insert --a--
Line 36, after "non-biased" change "removably" to --removable--

Column 14,
Line 5, after "so long as" change "the" to --they--
Line 17, after "as shown in FIG. 1" insert --,--

Column 16,
Line 2, change "form another." to --from another--
Line 45, before "second end" insert --the--

Column 17,
Line 1, change "tensions" to --tensioned--

Column 18,
Line 57, change "comprise" to --comprises--

Signed and Sealed this

Twenty-sixth Day of September, 2006

JON W. DUDAS
*Director of the United States Patent and Trademark Office*